US009470444B1

(12) United States Patent
Takata et al.

(10) Patent No.: US 9,470,444 B1
(45) Date of Patent: Oct. 18, 2016

(54) AIR CONDITIONER

(71) Applicant: DAIKIN INDUSTRIES, LTD., Osaka-shi, Osaka (JP)

(72) Inventors: Nobuyoshi Takata, Kusatsu (JP); Akira Moriguchi, Kusatsu (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 150 days.

(21) Appl. No.: 14/374,724

(22) PCT Filed: Nov. 22, 2012

(86) PCT No.: PCT/JP2012/080264

§ 371 (c)(1),
(2) Date: Jul. 25, 2014

(87) PCT Pub. No.: WO2013/111436

PCT Pub. Date: Aug. 1, 2013

(30) Foreign Application Priority Data

Jan. 26, 2012 (JP) ..... 2012-013758

(51) Int. Cl.
*F25B 49/02* (2006.01)
*F24F 11/02* (2006.01)

(52) U.S. Cl.
CPC ..... *F25B 49/02* (2013.01); *F24F 11/02* (2013.01)

(58) Field of Classification Search
CPC ..... F24F 11/02
See application file for complete search history.

(56) References Cited

U.S. PATENT DOCUMENTS 5,853,123 A * 12/1998 Okano ..... F24F 11/0009 165/205
2012/0033745 A1* 2/2012 Jo ..... F24F 11/006 375/257

FOREIGN PATENT DOCUMENTS

| | | | |
|---|---|---|---|
| JP | 63-306346 A | | 12/1988 |
| JP | 2001-355896 A | | 12/2001 |
| JP | 2005257238 A | * | 9/2005 |
| JP | 2009-041857 A1 | | 2/2009 |
| JP | 2009041857 A | * | 2/2009 |
| JP | 4547950 B2 | | 9/2010 |

* cited by examiner

*Primary Examiner* — Emmanuel Duke
(74) *Attorney, Agent, or Firm* — Birch, Stewart, Kolasch & Birch, LLP

(57) ABSTRACT

An indoor-unit transmission/reception unit and an outdoor-unit transmission/reception unit are connected via a first signal line, and another indoor-unit transmission/reception unit and another outdoor-unit transmission/reception unit are connected via a second signal line. A first return switch is connected between a first power supply line and the first signal line, and a second return switch is connected between the first power supply line and the second signal line. A first end of a second switch is connected to the first power supply line, and a second end of the second switch is connected to the cathodes of two diodes. The anodes of the first and the second diodes are connected to the first and the second signal lines, respectively. A common end of the second switch is connected to the first end or the second end thereof. An outdoor-power supply unit is fed with electric power from the common end of the second switch and the second power supply line.

12 Claims, 4 Drawing Sheets

AIR CONDITIONER

TECHNICAL FIELD

The present invention relates to an air conditioner.

BACKGROUND ART

Until now, a technique has been proposed which allows a signal line serving as a medium of transmission and reception of signals between an indoor unit and an outdoor unit of an air conditioner to additionally serve as a function of power supply (power feeding) under a certain circumstance. Hereinafter, this will be briefly introduced.

For example, when a cooling and heating function of an indoor unit is not necessary and only an air-blowing function is required to function, a refrigerant cycle operation of an outdoor unit is not necessary. For such a case, one proposal has been made that the driving of a compressor of the outdoor unit is stopped to make the outdoor unit transition into a so-called operation-standby mode so that the power consumption is reduced. In this case, a path for feeding power to the compressor, and a path for feeding power to a control device which controls the driving of the compressor are interrupted. However, the power supply path of the control device which controls the driving of the compressor is connected to a signal line.

For the return from the operation-standby mode to a normal operation, electric power is fed to the signal line in the indoor unit side and a driving power is supplied to the control device. Thereby, the above power feeding path is connected to the compressor to drive. Such a technique is introduced, for example, in Japanese Patent Publication No. 4547950 described below.

On the other hand, an air conditioner in which a single outdoor unit is connected to a plurality of indoor units (hereinafter referred to as "a multi-indoor unit type air conditioner") has also been proposed until now. The multi-indoor unit type air conditioner is provided with a plurality of signal lines, corresponding to the indoor units. The outdoor unit includes transmission/reception units to each of signal lines, and performs transmission and reception of signals for each of indoor units. Such a technique is introduced, for example, in Japanese Patent Application Laid-Open No. 63-306346 (1988) described below.

SUMMARY OF INVENTION

Problems to be Solved by the Invention

If the technique of Japanese Patent Publication No. 4547950 is merely applied to the multi-indoor-unit type air conditioner, then the plurality of signal lines will be connected to one another, in order to feed power to the control device of the outdoor unit. However, this will result in broadcasting a signal to the plurality of indoor units, irrespective of trying to send a signal for each of the indoor units.

In order to solve the problem, an object of the present invention is to allow a signal line to serve as a function of power feeding for a transition from the operation standby to the normal operation, so that transmission and reception of signals between an outdoor unit and one indoor unit does not function as transmission and reception of signals between the outdoor unit and another indoor unit.

Means for Solving the Problems

A first aspect of an air conditioner of the present invention includes a first power supply line (L1) and a second power supply line (L2) between which electric power is applied; an outdoor unit (20); a plurality of indoor units (10A, 10B); and a plurality of signal lines (SA, SB) which are provided corresponding to each of indoor units and each serves as a medium of transmission and reception of signals between the corresponding indoor unit and the outdoor unit.

Each of the indoor units includes an indoor-unit control unit (12A, 12B); an indoor-power supply unit (11A, 11B) which is fed with electric power from the first power supply line and the second power supply line and supplies indoor-unit controlling power to the indoor-unit control unit; an indoor-unit transmission/reception unit (15A, 15B) which is connected to one of the signal lines, the one corresponding to each of indoor units, and performs the transmission and reception of signals with the outdoor unit; and a return switch (MR10A, MR10B) which is connected between the one of the signal lines and the first power supply line, and whose conduction/non-conduction is controlled by the indoor unit control unit.

The outdoor unit includes an outdoor unit control unit (21); a first switch (MRM10) which has one end connected to the first power supply line and the other end, and whose conduction/non-conduction between the first end and the other end is controlled by the outdoor-unit control unit; a second switch (MR30) which has a first end connected to the first power supply line, a second end, and a common end to which only one of the first end and the second end is connected based on a control by the outdoor-unit control unit; a plurality of diodes (27A, 27B) which are provided corresponding to each of the indoor units and respectively have anodes connected to the corresponding one of the signal lines and a cathode connected to the second end; an outdoor-power supply unit (22) which is connected to the common end and the second power supply line, connected to the first power supply line via the second switch, or via the second switch, the diodes and the return switches, and supplies outdoor-unit controlling power to the outdoor-unit control unit; a plurality of outdoor-unit transmission/reception units (25A, 25B) which are provided corresponding to each of the indoor units and connected to the corresponding of the signal lines; and a compressor (23) which receives compressor-use power from the second power supply line and the other end.

The outdoor-unit control unit makes the first switch have conduction upon a start of power feeding of the outdoor-unit controlling power, and makes the first switch have non-conduction and makes the common end of the second switch connect with the second end upon a transition from a normal operation of the air conditioner to an operation standby, and the transition into the normal operation is performed by making any of the return switches of the indoor units have conduction in the operation standby.

In a second aspect of the air conditioner of the present invention according to the first aspect, the indoor-unit transmission/reception units (15A, 15B) of all of the indoor units are connected between corresponding one of the signal lines and the second power supply line (L2).

The outdoor unit further includes a transmission power supply unit (24) which is connected to the first power supply line and the second power supply line to receive the electric power, and which supplies a dc voltage, having a high potential with respect to the second power source line, to all of the outdoor-unit transmission/reception units (25A, 25B).

In a third aspect of the air conditioner of the present invention according to the first or second aspect, the outdoor unit (20) further includes a plurality of third switches (28A, 28B) which are provided between the anodes of the diodes (27A, 27B) and the outdoor-unit transmission/reception units (25A, 25B), which are corresponding each other respectively.

The outdoor-unit control unit (21) makes a switch of the third switches have non-conduction, the switch only corresponding to the indoor unit having the return switch that is estimated to have a short-circuit fault.

In a fourth aspect of the air conditioner of the present invention according to any one of the first to the third aspects, the outdoor-unit control unit (21) performs a first operation which makes the common end of the second switch connect with the first end, upon a start of power feeding of the outdoor-unit controlling power.

The indoor-unit control unit (12A) of one of the indoor units (10A) with the return switch (MR10A) having conduction makes the return switch have non-conduction, after a first time which is expected to be necessary to execute the first operation from the start of the conduction of this return switch.

In a fifth aspect of the air conditioner of the present invention according to the third aspect, the outdoor-unit control unit (21) performs a first operation which makes the common end of the second switch connect with the first end, upon a start of power feeding of the outdoor-unit controlling power. The indoor-unit control unit (12A) of one of the indoor units (10A) with the return switch (MR10A) having conduction makes the return switch have non-conduction, after a first time which is expected to be necessary to execute the first operation from the start of the conduction of this return switch. The outdoor-unit control unit (21) identifies the indoor units having the return switch that is estimated to have a short-circuit fault, by sequentially making only one of the third switches (28A, 28B) have non-conduction, and by determining failure/non-failure on the transmission and reception of signals.

In a sixth aspect of the air conditioner of the present invention according to the fifth aspect, the failure/non-failure on the transmission and reception of signals is determined as dead time which is longer than a product of the first time and the number of the indoor units.

Effects of the Invention

According to the first aspect of the air conditioner of the present invention, the compressor and the outdoor-power supply unit are not operated in the operation standby, so that the power consumption of the outdoor unit can be reduced. By making a return switch of any of the indoor units have conduction in the operation standby, the first power source line is connected to the outdoor-power supply unit via the return switch, a diode, and the second switch, and thus electric power is supplied from the first and the second power supply lines to the outdoor-power supply unit. Therefore, the outdoor-power supply unit supplies the driving power to the outdoor-unit control unit and the outdoor-unit control unit makes the first switch have conduction. Therefore, the compressor is connected not only to the second power supply line but also to the first power supply line via the first switch, and receives the compressor-use power. Thus, the air conditioner transitions from the operation standby to the normal operation.

It is noted that the diodes directed to mutually reverse directions via the second end are connected in series between the signal lines corresponding to different indoor units. Thus, transmission and reception of signals between the outdoor unit and one indoor unit does not function as transmission and reception of signals between the outdoor unit and the other indoor unit.

According to the second aspect of the air conditioner of the present invention, it is possible to perform transmission and reception of signals, utilizing changes in potential with respect to the dc voltage.

According to the third aspect of the air conditioner of the present invention, as a reason by which transmission and reception of signals are not performed normally, a short-circuit fault due to a welding of a return switch is conceivable. The short-circuit fault hinders the function of the transmission power supply unit. Therefore, the failure of the function of the transmission power supply unit, caused by the short-circuit fault, is avoided by making a third switch have non-conduction, the third switch being corresponds to an indoor unit having a return switch that is assumed to have a short-circuit fault.

According to the fourth aspect of the air conditioner of the present invention, after the transition from the operation standby to the normal operation, the signal lines are disconnected from the first power supply line, so that transmission and reception of signals through the signal lines are enabled.

According to the fifth aspect of the air conditioner of the present invention, in the case that the transmission and reception of signals have failure when all of the third switches have conduction, and only one of third switches has non-conduction so that the transmission and reception of signals become normal, it is determined that a return switch of an indoor unit corresponding to the third switch with non-conduction has a short-circuit fault. Accordingly, it is possible to identify the indoor unit having the return switch that is assumed to have a short-circuit fault, by sequentially making one of the third switches have non-conduction.

An object, feature, aspect, and advantage of the present invention will be more apparent from the following detailed description and the accompanying drawings.

DESCRIPTION OF EMBODIMENTS

First Embodiment

Figure 1:
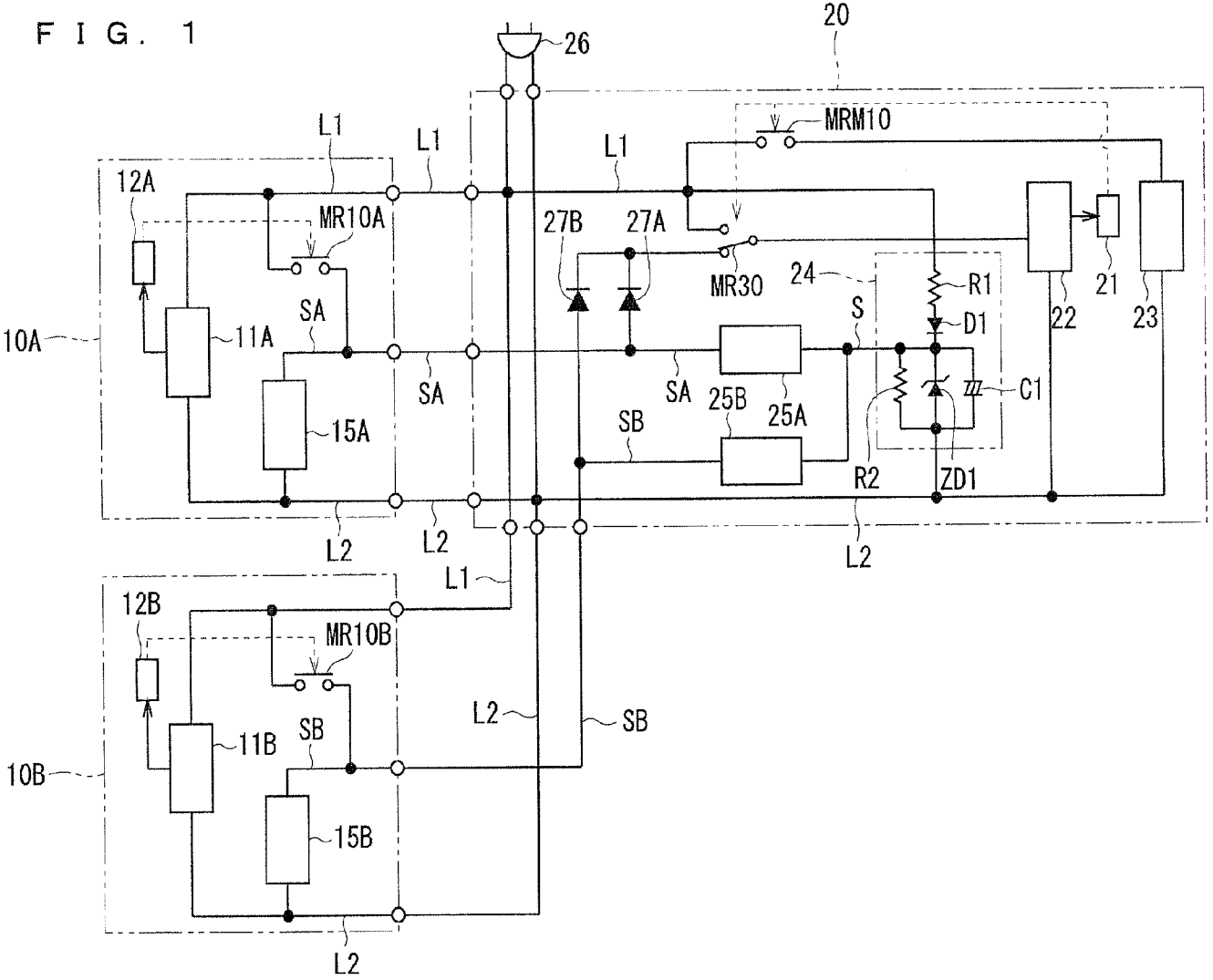
FIG. 1 is a circuit diagram illustrating the configuration of an air conditioner according to a first embodiment.

FIG. 1 is a diagram illustrating the configuration of an air conditioner according to a first embodiment. The air conditioner includes power supply lines L1, L2, an outdoor unit 20, a plurality of indoor units (shown here as two) 10A, 10B, and signal lines SA, SB.

Between the power supply lines L1, L2, electric power, such as ac power, is supplied from a commercial-power-source input unit 26.

The signal lines SA, SB are respectively provided corresponding to the indoor units 10A, 10B, and serve as media for transmission and reception of signals between the indoor units 10A, 10B and the outdoor unit 20.

The indoor unit 10A includes an indoor-power supply unit 11A, an indoor-unit control unit 12A, an indoor-unit transmission/reception unit 15A, and a return switch MR10A.

The indoor-power supply unit 11A, fed with electric power from the power supply lines L1, L2, supplies indoor-unit controlling power to the indoor-unit control unit 12A.

The indoor-unit transmission/reception unit 15A, which is connected to the signal line SA corresponding to the indoor unit 10A, performs transmission and reception of signals between the indoor unit 10A and the outdoor unit 20.

The return switch MR10A is connected between the signal line SA and the power supply line L1. The conduction/non-conduction of the return switch MR10A is controlled by the indoor-unit control unit 12A.

The indoor unit 10B includes an indoor-power supply unit 11B, an indoor-unit control unit 12B, an indoor-unit transmission/reception unit 15B, and a return switch MR10B. The indoor-power supply unit 11B, the indoor-unit control unit 12B, the indoor-unit transmission/reception unit 15B, and the return switch MR10B have identical connection and function with the indoor-power supply unit 11A, the indoor-unit control unit 12A, the indoor-unit transmission/reception unit 15A, and the return switch MR10A, respectively.

The outdoor unit 20 includes an outdoor-unit control unit 21, an outdoor-power supply unit 22, a compressor 23, outdoor-unit transmission/reception units 25A, 25B, a first switch MRM10, a second switch MR30, and a plurality of diodes 27A, 27B.

The first switch MRM10 has one end and the other end, and the conduction/non-conduction between the one end and the other end is controlled by the outdoor-unit control unit 21. The one end is connected to the power supply line L1.

The second switch MR30 has a first end, a second end, and a common end. The common end is connected to only one of the first end and the second end, depending on the control by the outdoor-unit control unit 21. The first end is connected to the power supply line L1.

The compressor 23 receives compressor-use power from the power supply line L2 and the other end of the first switch MRM10. The compressor 23 has a function to compress a refrigerant which is required to operate the air conditioner. The technique described herein is not directly related to the refrigerant cycle itself, and thus the mechanism and description of the refrigerant cycle are omitted.

The outdoor-unit transmission/reception units 25A, 25B are provided corresponding to the indoor units 10A, 10B, and connected to the corresponding signal lines SA, SB, respectively.

The diodes 27A, 27B are provided corresponding to the indoor units 10A, 10B, and the anodes of the diodes 27A, 27B are connected to the corresponding signal lines SA, SB, respectively. The cathodes of the diodes 27A, 27B are both connected to the second end of the second switch MR30.

The outdoor-power supply unit 22 is connected to the common end of the second switch MR30 and to the power supply line L2. Thereby, the outdoor-power supply unit 22 is connected to the power supply line L1 via the second switch MR30, or via the second switch MR30, the diode 27A and the return switch MR10A, or via the second switch MR30, the diode 27B and the return switch MR10B. Through the connection with the power supply lines L1, L2, the outdoor-power supply unit 22 supplies outdoor-unit controlling power to the outdoor-unit control unit 21.

The outdoor unit 20 is further provided with a transmission power supply unit 24. The transmission power supply unit 24 supplies a dc voltage, which has a high potential with respect to the power source line L2, to all of the outdoor-unit transmission/reception units 25A, 25B via a signal line S.

The transmission power supply unit 24 includes a diode D1, a zener diode ZD1, and a smoothing capacitor C1. The diode D1 and the zener diode ZD1 are connected in series to each other between the power source lines L1, L2, with the anode of the diode D1 being directed toward the side of the power supply line L1 and the anode of the zener diode ZD1 being directed toward the side of the power source line L2. The smoothing capacitor C1 is connected to the zener diode ZD1 in parallel.

The dc voltage which is rectified by the diode D1 is smoothed by the smoothing capacitor C1. It is noted that the smoothed dc voltage does not exceed a voltage value specified in the zener diode ZD1. The potential at the cathode of the zener diode ZD1 is applied to the signal line S.

The diode D1 may be provided with a resistor R1. The resistor R1 can prevent overcurrent from flowing through the zener diode ZD1 and the smoothing capacitor C1.

In addition, the zener diode ZD1 and the smoothing capacitor C1 may be provided with a resistor R2 connected thereto in parallel. The resistor R2 can prevent overvoltage from being applied across the zener diode ZD1 and the smoothing capacitor C1.

Figure 2:
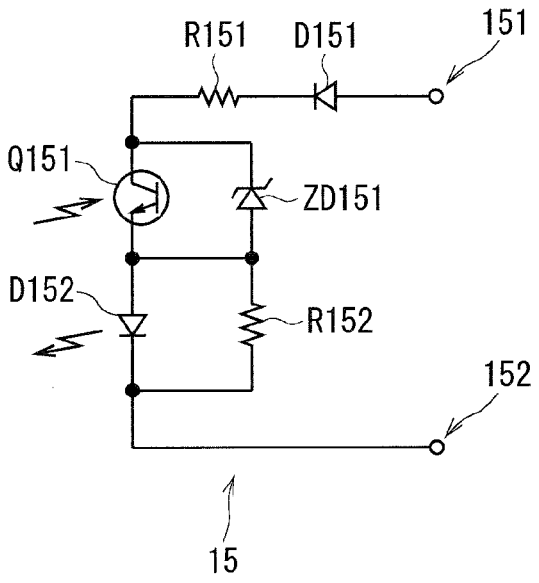
FIG. 2 is a circuit diagram illustrating the configuration of an indoor-unit transmission/reception unit.

FIG. 2 is a circuit diagram illustrating the configuration of an indoor-unit transmission/reception unit 15 which can be used as the indoor-unit transmission/reception units 15A, 15B.

The indoor-unit transmission/reception unit 15 has terminals 151, 152. When the indoor-unit transmission/reception units 15 are used as the indoor-unit transmission/reception units 15A, 15B, the terminals 151 are connected to the corresponding signal lines SA, SB. Even if the indoor-unit transmission/reception unit 15 is used for either of the indoor-unit transmission/reception units 15A, 15B, the terminal 152 is connected to the power source line L2.

The indoor-unit transmission/reception unit 15 includes a phototransistor Q151 and a light-emitting diode D152 which are connected in series to each other between the terminals 151, 152. The phototransistor Q151 is provided with a zener diode ZD151 connected thereto in parallel.

The light-emitting diode D152 is provided, with the anode being directed toward the side of the terminal 151 and the cathode being directed toward the side of the terminal 152.

The phototransistor Q151 is provided, with its forward direction being directed in the direction from the terminal 151 toward the terminal 152. As an example, the phototransistor Q151 is an NPN-type bipolar transistor, and is disposed with the collector and the emitter being directed toward the terminal 151 and the terminal 152, respectively.

The zener diode ZD151 is provided, with the cathode being directed toward the side of the terminal 151 and the anode being directed toward the side of the terminal 152.

The phototransistor Q151 has conduction/non-conduction with the reception of pulsed light which is emitted by a light-emitting mechanism (not shown), based on the control of the indoor-unit control unit 12A. Depending on the conduction/non-conduction of the phototransistor Q151, a corresponding low/high potential at the terminal 151 is set. That is, the phototransistor Q151 serves as a function of sending an "L" active signal from the indoor unit 10A or the indoor unit 10B to the outdoor unit 20.

When receiving a signal from the outdoor unit 20, more specifically, from the outdoor-unit transmission/reception unit 25A or 25B, the phototransistor Q151 remains OFF. When the potential at the terminal 151 is set to a high/low by the outdoor-unit transmission/reception unit 25A or 25B, the zener diode ZD 151 correspondingly has conduction/non-conduction and the light-emitting diode D152 correspondingly turns ON/OFF. Such a blink of light is converted into an electric signal by a light-receiving mechanism (not shown), which is sent to the indoor-unit control unit 12A. That is, the light-emitting diode D152 serves as a function of receiving a "H" active signal (described later) from the outdoor unit 20.

Between the terminals 151, 152, the phototransistor Q151 and the light-emitting diode D152 are desirably provided with a resistor R151 and a diode D151 connected thereto in series. The diode D151 is provided, with the cathode being directed toward the side of the terminal 152 and the anode being directed toward the side of the terminal 151.

The resistor R151 prevents overvoltage from being applied across the phototransistor Q151 and across the light-emitting diode D152. The diode D151 shapes the waveforms of the "L" active signal to be sent from the indoor unit 10A or the indoor unit 10B to the outdoor unit 20 and the "H" active signal from the outdoor unit 20.

In addition, the light-emitting diode D152 is desirably provided with a resistor R152 connected thereto in parallel, which prevents overcurrent from flowing through the light-emitting diode D152.

Figure 3:
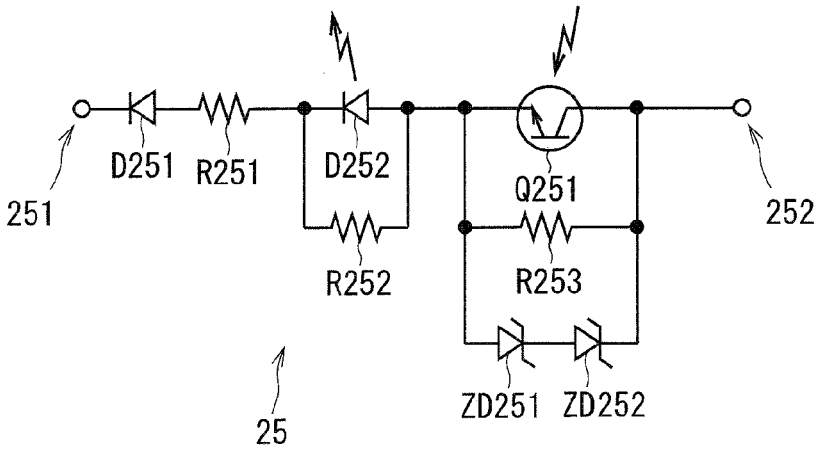
FIG. 3 is a circuit diagram illustrating the configuration of an outdoor-unit transmission/reception unit.

FIG. 3 is a circuit diagram illustrating the configuration of an outdoor-unit transmission/reception unit 25 which can be used as the outdoor-unit transmission/reception units 25A, 25B.

The outdoor-unit transmission/reception unit 25 has terminals 251, 252. When the outdoor-unit transmission/reception units 25 are used as the outdoor-unit transmission/reception units 25A, 25B, the terminals 251 are connected to the corresponding signal lines SA, SB. Even if the outdoor-unit transmission/reception unit 25 is used for either of the outdoor-unit transmission/reception units 25A, or 25B, the terminal 252 is applied with a dc voltage, from the transmission power supply unit 24 via the signal line S.

The outdoor-unit transmission/reception unit 25 includes a phototransistor Q251 and a light-emitting diode D252 which are connected in series to each other between the terminals 251, 252. In addition, a structure in which zener diodes ZD251, ZD252 are connected in series to each other (hereinafter, provisionally referred to as "a series connection body") is connected to the phototransistor Q251 in parallel.

The light-emitting diode D252 is provided, with the anode being directed toward the side of the terminal 252 and the cathode being directed toward the side of the terminal 251.

The phototransistor Q251 is provided, with its forward direction being directed in the direction from the terminal 252 toward the terminal 251. As an example, the phototransistor Q251 is an NPN-type bipolar transistor, and is disposed with the collector and the emitter being directed toward the terminal 252 and the terminal 251, respectively.

The zener diodes ZD251, ZD252 are both provided, with the cathodes being directed toward the side of the terminal 252 and the anodes being directed toward the side of the terminal 251.

The phototransistor Q251 has conduction/non-conduction with the reception of pulsed light which is emitted by a light-emitting mechanism (not shown), based on the control of the outdoor-unit control unit 21. Depending on the conduction/non-conduction of the phototransistor Q 251, a corresponding high/low potential at the terminal 251 is set. That is, the phototransistor Q251 serves as a function of sending a "H" active signal from the outdoor unit 20 to the indoor unit 10A or the indoor unit 10B.

When receiving a signal from the indoor unit 10A, 10B, more specifically, from the indoor-unit transmission/reception unit 15A or the indoor-unit transmission/reception unit 15B, the phototransistor Q251 remains OFF. When the potential at the terminal 251 is set to a low/high by the indoor-unit transmission/reception unit 15A or the indoor-unit transmission/reception unit 15B, the series connection body correspondingly has conduction/non-conduction and the light-emitting diode D252 correspondingly turns ON/OFF. Such a blink of light is converted into an electric signal by a light-receiving mechanism (not shown), which is sent to the outdoor-unit control unit 21. That is, the light-emitting diode D252 serves as a function of receiving an "L" active signal from the indoor unit 10A or 10B.

Between the terminals 251, 252, the phototransistor Q251 and the light-emitting diode D252 are desirably provided with a resistor R251 and a diode D251 connected thereto in series. The diode D251 is provided, with the cathode being directed toward the side of the terminal 251 and the anode being directed toward the side of the terminal 252.

The resistor R251 prevents overvoltage from being applied across the phototransistor Q251 and across the light-emitting diode D252. The diode D251 shapes the waveforms of the "L" active signal sent from the indoor unit 10A or the indoor unit 10B to the outdoor unit 20 and the "H" active signal from the outdoor unit 20.

In addition, the light-emitting diode D252 is desirably provided with a resistor R252 connected thereto in parallel, which prevents overcurrent from flowing through the light-emitting diode D252.

Also, the phototransistor Q251 and the series connection body are desirably provided with a resistor R253 connected thereto in parallel. The resistor R253 prevents overcurrent from flowing through the phototransistor Q251 and the series connection body.

In order to perform transmission and reception of the "H" active signal and the "L" active signal via the signal lines SA, SB as described above, the transmission power supply unit 24 applies a DC voltage having a high potential with respect to the power source line L2, such as a voltage of 55V, to the signal line S, as a reference voltage to these signals. Thus, depending on the transmission power supply unit 24, it is possible to perform transmission and reception of signals, utilizing changes in electric potential with respect to the de voltage.

<Brief Description of Operation in Normal Operation>

In the normal operation, the common end of the second switch MR30 is connected to the first end, and through which the outdoor-power supply unit 22 is connected to the power source line L1. The outdoor-power supply unit 22 is also connected to the power source line L2. The power source lines L1, L2 are supplied with electric power from the commercial-power-source input unit 26. Accordingly, the outdoor-power supply unit 22 is operated and the outdoor-unit control unit 21 is supplied with the outdoor-unit controlling power.

With the supply of the outdoor-unit controlling power, the outdoor-unit control unit 21 operates and makes the first switch MRM10 have conduction. Since the first switch MRM10 thus has conduction in the normal operation, the compressor 23 is connected not only to the power source line L2 but also to the power source line L1 via the first switch MRM10, and receives the compressor-use power. Thus, the compressor 23 is driven.

The outdoor-unit control unit 21 causes the common end of the second switch MR30 to continue being connected with the first end. In the normal operation, the return switches MR10A, MR10B are both non-conductive. Accordingly, the signal lines SA, SB are both interrupted from the power source line L1, by the operation of the second switch MR30 in the outdoor unit 20, and by the operation of the return switches MR10A, MR10B in the indoor units 10A, 10B.

Thus, in the normal operation, the signal line SA operates along with the power source line L2, and serves as a medium of transmission and reception of pulsed-voltage signals between the transmission power supply unit 24 and the outdoor-unit transmission/reception unit 25A, and indoor-unit 10A. Similarly, the signal line SB operates along with the power source line L2, and serves as a medium of transmission and reception of pulsed-voltage signals between the transmission power supply unit 24 and the outdoor-unit transmission/reception unit 25B, and indoor-unit 10B. The transmission and reception of signals in itself is a known technique, and thus the more detailed description thereof is omitted herein.

In this embodiment, because the diodes 27A, 27B are connected in series and reversely to each other between the signal lines SA, SB, there is no transmission and reception of signals between the signal lines SA, SB. In other words, in the normal operation, even though the diodes 27A, 27B are present, transmission and reception of signals between the indoor unit 10A and the outdoor unit 20 do not function as transmission and reception of signals between the indoor unit 10B and the outdoor unit 20.

<Transition from Normal Operation to Operation Standby>

When only an air-blowing function is required to function for both of the indoor units 10A, 10B, a refrigerant cycle operation of the outdoor unit 20 is not necessary. Thus, depending on the control of the indoor-unit control units 12A, 12B, a power-saving request from the indoor units 10A, 10B is sent to the outdoor unit 20 via the signal lines SA, SB, respectively. Upon detecting that all of the indoor units 10A, 10B have issued the power-saving request, the outdoor-unit control unit 21 performs a process to stop the compressor 23. Specifically, the first switch MRM10 is caused to be non-conductive, and thereby the compressor 23 is caused to be stopped.

In addition, the outdoor-unit control unit 21 makes the common end of the second switch MR30 connect with the second end. Since the power feeding into the outdoor-power supply unit 22 is herewith interrupted, the outdoor-unit controlling power into the outdoor-unit control unit 21 is also interrupted. Therefore, the non-conduction of the first switch MRM10 is retained, and the connection of the second switch MR30 is also retained. In FIG. 1, the operation standby mode of the first switch MRM10, the second switch MR30, and the return switches MR10A, MR10B is shown.

<Transition from Operation Standby to Normal Operation (Return)>

When any of the indoor units 10A, 10B needs a refrigerant cycle operation, such as a cooling and heating operation, in the operation standby mode, the compressor 23 is required to be driven again. Thus, depending on the control of the indoor-unit control units 12A, 12B, the return switches MR10A, MR10B are correspondingly made to have conduction. Therefore, the transition from the operation standby to the normal operation is performed as follows. Hereinafter, the description will be made in the case that the return switch MR10A is made to have conduction.

With the conduction of the return switch MR10A, the signal line SA is connected to the power source line L1. Therefore, the outdoor-power supply unit 22 is connected to the power supply line L1 via the signal line SA, the diode 27A, and the second switch MR30, and is fed with electric power from the power source lines L1, L2.

With the power feeding into the outdoor-power supply unit 22 from the power supply lines L1, L2, the outdoor-unit control unit 21 is fed with the outdoor-unit controlling power, and the outdoor-unit control unit 21 starts operating. Upon a start of the power feeding of the outdoor-unit controlling power, the outdoor-unit control unit 21 makes the first switch MRM10 have conduction. Therefore, the compressor 23 is fed with electric power from the power source lines L1, L2 and is operated again, and the refrigerant cycle (not shown) is restarted.

In addition, upon the start of the power feeding of the outdoor-unit controlling power, the outdoor-unit control unit 21 makes the common end of the second switch MR30 connect with the first end (first operation). By the first operation, the power feeding from the power source line L1 through the signal lines SA, SB to the outdoor-power supply unit 22 is eliminated. After the completion of the first operation, the return switch MR10A is thus made to have non-conduction.

A variety of controls for making the return switch MR10A have non-conduction are conceivable. But, when the return switch MR10A has conduction, because the signal line SA is connected to the power source line L1, it is difficult to give an instruction from the outdoor unit 20 through the signal line SA to the indoor unit 10A.

As an example, the indoor-unit control unit 12A of the indoor unit 10A, in which the return switch MR10A has conduction, makes the return switch MR10A have non-conduction, after a first time which is expected to be necessary to execute the first operation from the start of the conduction of the return switch MR10A.

After the transition from the operation standby to the normal operation, by making the return switch MR10A have non-conduction in this manner, it is possible to disconnect the signal line SA from the power source line L1 and perform transmission and reception of signals through the signal line SA.

As described above, according to the embodiment, the compressor 23 and the outdoor-power supply unit 22 are not operated in the operation standby, so that the power consumption of the outdoor unit 20 can be reduced.

By making any of the return switches MR10A, MR10B of the indoor units 10A, 10B have conduction in the operation standby, the outdoor-power supply unit 22 is connected to the power source line L1 via the return switches MR10A, MR10B, the diodes 27A, 27B, and the second switch MR30. Therefore, electric power is supplied from the power source lines L1, L2 to the outdoor-power supply unit 22.

Thus, the outdoor-power supply unit 22 supplies the driving power to the outdoor-unit control unit 21, and the outdoor-unit control unit 21 makes the first switch MRM10 have conduction. Therefore, the compressor 23 is connected not only to the power source line L2 but also to the power source line L1 via the first switch MRM10, and receives the compressor-use power. Therefore, the air conditioner transitions from the operation standby to the normal operation.

Additionally, the diodes 27A, 27B are connected in series and reversely to each other, via the second end, between the signal lines SA, SB corresponding to the different indoor units 10A, 10B. Thus, transmission and reception of signals between the outdoor unit 20 and the indoor unit 10A do not function as transmission and reception of signals between the outdoor unit 20 and the indoor unit 10B.

After the transition from the operation standby to the normal operation, it is possible to disconnect the signal lines SA, SB from the power source line L1 and perform transmission and reception of signals through the signal lines SA, SB.

Furthermore, through the function of the transmission power supply unit 24, it is possible to perform transmission and reception of signals, utilizing changes in potential with respect to the dc voltage.

Second Embodiment

Figure 4:
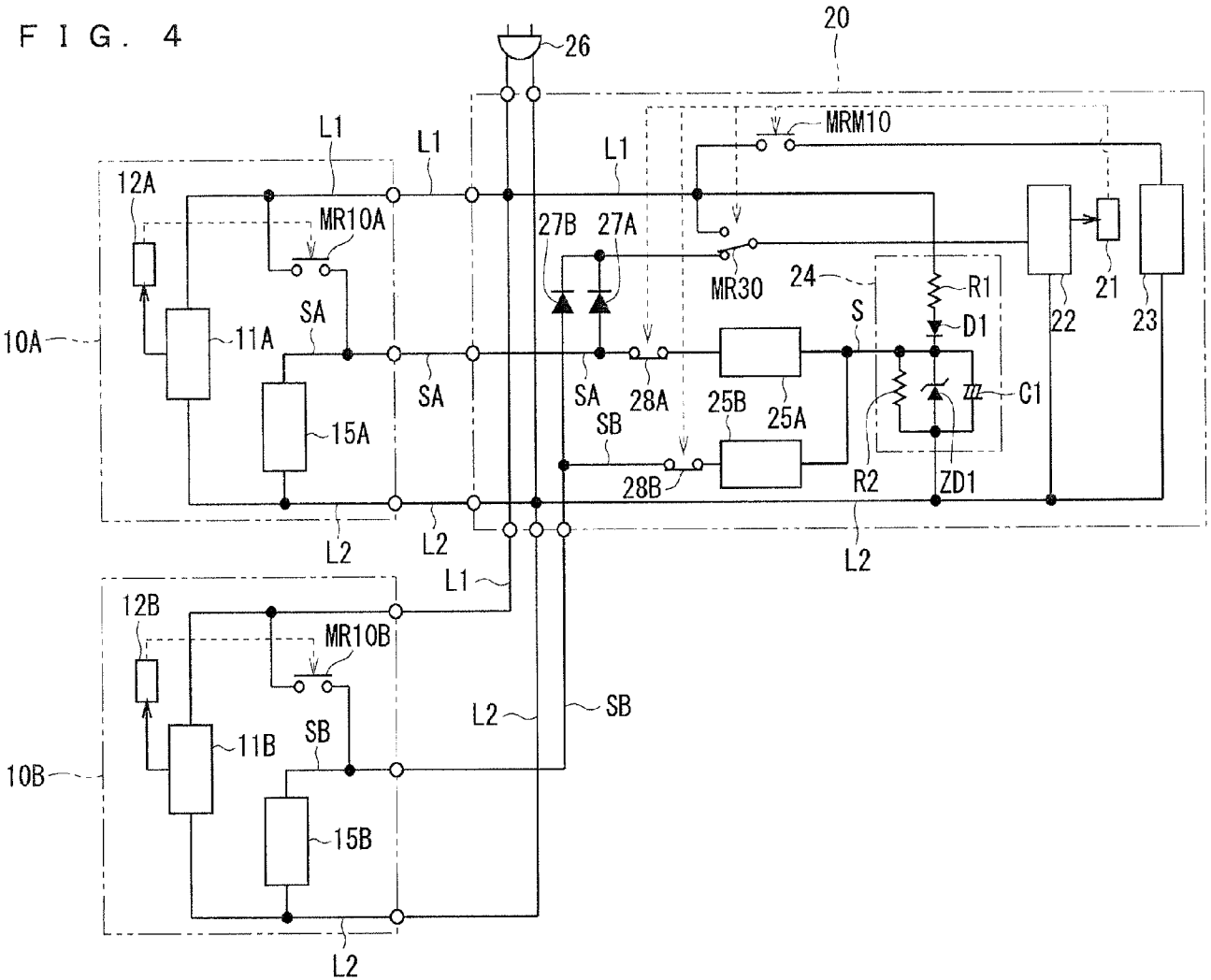
FIG. 4 is a circuit diagram illustrating the configuration of an air conditioner according to a second embodiment.

FIG. 4 is a circuit diagram illustrating the configuration of an air conditioner according to a second embodiment. The air conditioner has an additional configuration to the configuration of the air conditioner according to the first embodiment, in which third switches 28A, 28B are added to the outdoor unit 20.

Specifically, the third switch 28A is provided between the anode of the diode 27A and the outdoor-unit transmission/reception unit 25A, and the third switch 28B is provided between the anode of the diode 27B and the outdoor-unit transmission/reception unit 25B.

The outdoor-unit control unit 21 makes a switch of the third switches 28A, 28B have non-conduction, only the switch corresponding to the indoor units 10A, 10B having the return switches MR10A, MR10B that is estimated to have a short-circuit fault. If there is no indoor unit which is estimated to have a short-circuit fault, then the third switches 28A, 28B have conduction and the operation of the second embodiment is applied with the operation described in the first embodiment.

Hereinafter, meaning of providing the third switches 28A, 28B will be described. As a reason of the problem that normal transmission and reception of signals are not performed between the indoor unit 10A, 10B and the outdoor unit 20, a short-circuit fault of the return switches MR10A, MR10B is conceivable. An aspect of the short-circuit fault is a welding, for example.

In the configuration of the first embodiment, if the return switch MR10A has a short-circuit fault, then the power supply line L1 is connected to the signal line SA and the blink of the light-emitting diode D152 (see FIG. 2) of the indoor unit transmission/reception unit 15A is influenced, not only by the conduction/non-conduction of the phototransistor Q251 (see FIG. 3) of the outdoor unit transmission/reception unit 25A, but also by the potential on the power supply line L1. Therefore, normal transmission and reception of signals cannot be performed between the indoor unit 10A and the outdoor unit 20.

In addition, from the smoothing capacitor C1 to the power supply line L1, a discharge path is formed by a series connection of the signal line S, the outdoor-unit transmission/reception unit 25A and the return switch MR10A having a short-circuit fault. As a result, the dc voltage provided by the transmission power supply unit 24 to the signal line S can no longer have a normal value, so that the short-circuit fault hinders the function of the transmission power supply unit 24. This hinders even normal transmission and reception of signals performed between the indoor unit 10B having the return switch MR10B without short-circuit fault and the outdoor unit 20.

Accordingly, the third switch 28A corresponding to the return switch MR10A that is estimated to have a short-circuit fault is made to have non-conduction. Therefore, the above discharge path is interrupted. But, even with such measures, transmission and reception of signals between the indoor unit 10A and the outdoor unit 20 cannot still be performed normally. However, because the failure of the function of the transmission power supply unit 24 can be avoided, the transmission and reception of signals between the indoor unit 10B and the outdoor unit 20 are performed normally.

As to estimating which of the return switches MR10A, MR10B has a short-circuit fault, the following method can be adopted.

Generally, in the transmission and reception of signals in a multi-indoor-unit type air conditioner, communication from an outdoor unit to individual indoor units is performed sequentially, in order to identify the plurality of indoor units. In this embodiment, in the normal operation, the outdoor-unit transmission/reception unit 25A first outputs a "H" active signal to the signal line SA, then the indoor-unit transmission/reception unit 15A receives this signal and outputs a signal, which also functions as an acknowledge, to the signal line SA with "L" active. The outdoor-unit control unit 21 analyzes the signal and determines whether the indoor unit 10A is normally operating.

Subsequently, the outdoor-unit transmission/reception unit 25B outputs a "H" active signal to the signal line SB, then the indoor-unit transmission/reception unit 15B receives this signal and outputs a signal, which also functions as an acknowledge, to the signal line SB with "L" active. The outdoor-unit control unit 21 analyzes the signal and determines whether the indoor unit 10B is normally operating.

If any of the return switches MR10A, MR10B has a short-circuit fault, then normal communication with any of the indoor units 10A, 10B is not performed, as described above. That is, the return switch MR10A, MR10B in any of indoor units 10A, 10B may have a short-circuit fault.

Accordingly, upon the determination that both of the indoor units 10A, 10B are not normally operating or are not able to perform normal communication, the outdoor-unit control unit 21 performs a second operation to identify an indoor unit which is estimated to have a short-circuit fault.

In the second operation, the outdoor-unit control unit 21 sequentially makes one of the third switches 28A, 28B have non-conduction. In addition, by determining failure/non-failure on transmission and reception of signals, the outdoor-unit control unit 21 identifies an indoor unit having the return switch that is estimated to have a short-circuit fault.

Figure 5:
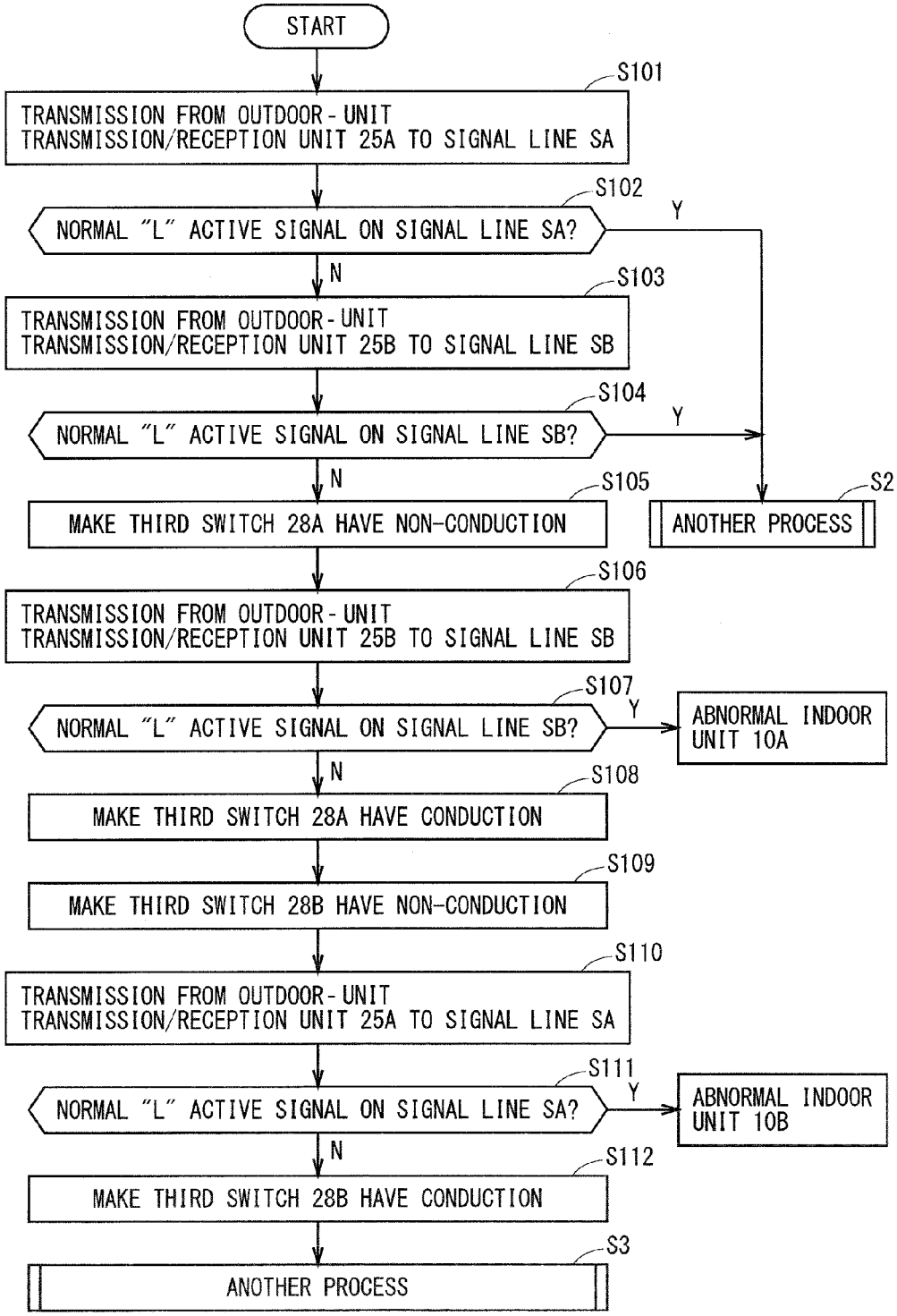
FIG. 5 is a flowchart illustrating the operation of the air conditioner in the second embodiment.

FIG. 5 is a flowchart illustrating the operation of the outdoor-unit control unit 21 in the second operation and the preceding operation thereof. In Step S101, transmission from the outdoor-unit transmission/reception unit 25A to the signal line SA is performed. In Step S102, it is determined whether a normal "L" active signal is transmitted to the signal line SA. If the result of the determination in Step S102 is affirmative, then this process determines that the above short-circuit fault has not occurred and proceeds to another process in Step S2. That is, the second operation is not performed.

If the result of the determination of Step S102 is negative, then transmission from the outdoor-unit transmission/reception unit 25B to the signal line SB is performed in Step S103. In Step S104, it is determined whether a normal "L" active signal is transmitted to the signal line SB. If the result of the determination in Step S104 is affirmative, then this process determines that the above short-circuit fault has not occurred, and proceeds to another process in Step S2. That is, the second operation is not performed.

If the result of the determination in Step S104 is negative, this means that both of the indoor units 10A, 10B are not normally operating or are not able to perform normal communication, and thus the second operation subsequent to Step S105 is performed.

At first, in Step S105, the third switch 28A is made to have non-conduction. Because transmission and reception of signals through the signal line SA is disable by this, it is determined whether transmission and reception of signals are normally performed to an indoor unit other than the indoor unit 10A, i.e. the indoor unit 10B in this embodiment. Specifically, in Step S106, transmission from the outdoor-unit transmission/reception unit 25B to the signal line SB is performed. In Step S107, it is determined whether a normal "L" active signal is transmitted to the signal line SB.

If the result of the determination in Step S107 is affirmative, the above short-circuit fault is estimated to occur in the return switch MR10A of the indoor unit 10A. Thus, the following operations are performed with a premise that the indoor unit 10A is not normal. As an example, the outdoor unit 20 may inform the outside that the return switch MR10A of the indoor unit 10A is not normal.

If the result of the determination in Step S107 is negative, the above short-circuit fault is estimated not to be produced in the return switch MR10A of the indoor unit 10A. Thus, in Step 108, the third switch 28A is made to have conduction.

Further, in step S109, the third switch 28B is made to have non-conduction. Because transmission and reception of signals through the signal line SB is disable by this, it is determined whether transmission and reception of signals are normally performed to an indoor unit other than the indoor unit 10B, i.e. the indoor unit 10A in this embodiment. Specifically, in Step S110, transmission from the outdoor-unit transmission/reception unit 25A to the signal line SA is performed. In Step S111, it is determined whether a normal "L" active signal is transmitted to the signal line SA.

If the result of the determination in Step S111 is affirmative, the above short-circuit fault is assumed to occur in the return switch MR10B of the indoor unit 10B. Thus, the following operations are performed with a premise that the indoor unit 10B is not normal. As an example, the outdoor unit 20 may inform the outside that the return switch MR10B of the indoor unit 10B is not normal.

If the result of the determination in Step S111 is negative, it is estimated that the transmission and reception of signals was not performed normally due to a different reason other than a short-circuit fault of the return switches MR10A, MR10B. Thus, in Step S112, the third switch 28B is made to have conduction and then this process proceeds to another process in Step S3. As an example, the outdoor-unit control unit 21 may force the compressor 23 to stop.

Thus, according to the second embodiment, in the case that the transmission and reception of signals have failure when all of the third switches 28A, 28B have conduction, and only one of them becomes non-conduction so that the transmission and reception of signals become normal, it is determined that a return switch of an indoor unit corresponding to the third switch with non-conduction has a short-circuit fault. Accordingly, it is possible to identify an indoor unit having the return switch that is estimated to have a short-circuit fault, by sequentially making only one of the third switches have non-conduction.

Desirably, a predetermined dead time is set for the determination of failure/non-failure on transmission and reception of signals in Steps S102, S104. Within the first time, the return switch MR10A, MR10B has conduction, and thus normal transmission and reception of signals cannot be performed. As a result, when all of the return switches MR10A, MR10B sequentially have conduction with a duration of the first time, it is not possible to perform normal transmission and reception of signals in the dead time which is a product of the first time and the number of the indoor units.

Therefore, it is desirable to perform the determination of failure/non-failure on transmission and reception of signals, with the dead time which is longer than the product of the first time and the number of the indoor units (indicated here as two).

Modification

Although any of the above embodiments is exemplified in the case that two indoor units are provided, it is apparent that the embodiments may also be applied in the case that three or more indoor units are provided.

When three or more indoor units are provided for an example, it is possible to perform an operation corresponding to a signal line other than the signal lines SA, SB, in Steps S106, S107 of the second embodiment.

As an example, the indoor-unit control units 12A, 12B, and the outdoor-unit control unit 21 include a microcomputer and a storage. The microcomputer executes each process step (in other words, procedure) written in a program. The storage may include one or more various storage devices, such as a ROM (Read Only Memory), a RAM (Random Access Memory), a rewritable nonvolatile memory (e.g., EPROM: Erasable Programmable ROM), and a hard disk device. The storage stores a variety of information and data, stores a program executed by the microcomputer, and provides a work area which is used for executing the program. It can be grasped that the microcomputer functions as a variety of means corresponding to each process step written in a program, or achieves a variety of functions corresponding to each process step.

Furthermore, the indoor-unit control units 12A, 12B, and the outdoor-unit control unit 21 may, not limited to this, achieve a part or all of a variety of procedures performed by the indoor-unit control units 12A, 12B, and the outdoor-unit control unit 21, or a part or all of a variety of means or functions accomplished thereby, with hardware.

Although the present invention has been described in detail, the above description is merely intended in all aspects to provide an example and thus the present invention is not limited thereto. It should be understood that an infinite number of unillustrated modifications can be conceivable without departing from the scope of the present invention.

The invention claimed is:

1. An air conditioner comprising:

a first power supply line and a second power supply line between which electric power is applied;

an outdoor unit;

a plurality of indoor units; and a plurality of signal lines which are provided corresponding to each of said indoor units and each serves as a medium of transmission and reception of signals between each of said indoor units and said outdoor unit, each of said indoor units including:

an indoor unit control unit;

an indoor-power supply unit which is fed with electric power from said first power supply line and said second power supply line and supplies indoor-unit controlling power to said indoor-unit control unit;

an indoor-unit transmission/reception unit which is connected to one of said signal lines, the one corresponding to each of said indoor units, and performs said transmission and reception of signals with said outdoor unit; and a return switch which is connected between said one of said signal lines and said first power supply line, and whose conduction/non-conduction is controlled by said indoor-unit control unit, said outdoor unit including:

an outdoor-unit control unit;

a first switch which has one end connected to said first power supply line and the other end, and whose conduction/non-conduction between said first end and said other end is controlled by said outdoor-unit control unit;

a second switch which has a first end connected to said first power supply line, a second end, and a common end to which only one of said first end and said second end is connected based on a control by said outdoor-unit control unit;

a plurality of diodes which are provided corresponding to each of said indoor units and respectively have anodes connected to corresponding one of said signal lines and a cathode connected to said second end;

an outdoor-power supply unit which is connected to said common end and said second power supply line; connected to said first power supply line via said second switch, or via said second switch, said diodes and said return switches; and supplies outdoor-unit controlling power to said outdoor-unit control unit;

a plurality of outdoor-unit transmission/reception units which are provided corresponding to each of said indoor units and each connected to corresponding one of said signal lines; and a compressor which receives electric power from said second power supply line and said other end, wherein said outdoor-unit control unit makes said first switch have conduction upon a start of power feeding of said outdoor-unit controlling power, and makes said first switch have non-conduction and makes said common end of said second switch connect with said second end upon a transition from a normal operation of said air conditioner to an operation standby; and wherein the transition into said normal operation is performed by making any of said return switches of said indoor units have conduction in said operation standby.

2. The air conditioner according to claim 1, wherein said indoor-unit transmission/reception units of all of said indoor units are connected between corresponding one of said signal lines and said second power supply line; and said outdoor unit further includes a transmission power supply unit which is connected to said first power supply line and said second power supply line to receive said electric power, and which supplies a dc voltage, having a high potential with respect to said second power source line, to all of said outdoor-unit transmission/reception units.

3. The air conditioner according to claim 1, wherein said outdoor unit further includes a plurality of third switches which are provided between said anodes of said diodes and said outdoor-unit transmission/reception units, which are corresponding each other respectively, said outdoor-unit control unit makes a switch of said third switches have non-conduction, the switch only corresponding to said indoor units having said return switch that is estimated to have a short-circuit fault.

4. The air conditioner according to claim 1, wherein said outdoor-unit control unit performs a first operation which makes said common end of said second switch connect with said first end, upon a start of power feeding of said outdoor-unit controlling power; and said indoor-unit control unit of said indoor unit with said return switch having conduction makes said return switch have non-conduction, after a first time which is expected to be necessary to execute said first operation from the start of the conduction of this return switch.

5. The air conditioner according to claim 3, wherein said outdoor-unit control unit performs a first operation which makes said common end of said second switch connect with said first end, upon a start of power feeding of said outdoor-unit controlling power;

said indoor unit control unit of said indoor unit with said return switch having conduction makes said return switch have non-conduction, after a first time which is expected to be necessary to execute the first operation from the start of the conduction of this return switch; and said outdoor-unit control unit identifies said indoor units in which said return switch is estimated to have a short-circuit fault, by sequentially making only one of said third switches have non-conduction, and by determining failure/non-failure on said transmission and reception of signals.

6. The air conditioner according to claim 5, wherein the failure/non-failure on said transmission and reception of signals is determined with dead time which is longer than a product of said first time and the number of said indoor units.

7. The air conditioner according to claim 2, wherein said outdoor unit further includes a plurality of third switches which are provided between said anodes of said diodes and said outdoor-unit transmission/reception units, which are corresponding each other respectively, said outdoor-unit control unit makes a switch of said third switches have non-conduction, the switch only corresponding to said indoor units having said return switch that is estimated to have a short-circuit fault.

8. The air conditioner according to claim 7, wherein said outdoor-unit control unit performs a first operation which makes said common end of said second switch connect with said first end, upon a start of power feeding of said outdoor-unit controlling power;

said indoor unit control unit of one of said indoor units with said return switch having conduction makes said return switch have non-conduction, after a first time which is expected to be necessary to execute the first operation from the start of the conduction of this return switch; and said outdoor-unit control unit identifies said indoor units in which said return switch is estimated to have a short-circuit fault, by sequentially making only one of said third switches have non-conduction, and by determining failure/non-failure on said transmission and reception of signals.

9. The air conditioner according to claim 8, wherein the failure/non-failure on said transmission and reception of signals is determined with dead time which is longer than a product of said first time and the number of said indoor units.

10. The air conditioner according to claim 2, wherein said outdoor-unit control unit performs a first operation which makes said common end of said second switch connect with said first end, upon a start of power feeding of said outdoor-unit controlling power; and said indoor-unit control unit of one of said indoor units with said return switch having conduction makes said return switch have non-conduction, after a first time which is expected to be necessary to execute said first operation from the start of the conduction of this return switch.

11. The air conditioner according to claim 3, wherein said outdoor-unit control unit performs a first operation which makes said common end of said second switch connect with said first end, upon a start of power feeding of said outdoor-unit controlling power; and said indoor-unit control unit of one of said indoor units with said return switch having conduction makes said return switch have non-conduction, after a first time which is expected to be necessary to execute said first operation from the start of the conduction of this return switch.

12. The air conditioner according to claim 7, wherein said outdoor-unit control unit performs a first operation which makes said common end of said second switch connect with said first end, upon a start of power feeding of said outdoor-unit controlling power; and said indoor-unit control unit of one of said indoor units with said return switch having conduction makes said return switch have non-conduction, after a first time which is expected to be necessary to execute said first operation from the start of the conduction of this return switch.

* * * * *